US005222724A

United States Patent [19]

Hirano et al.

[11] Patent Number: 5,222,724

[45] Date of Patent: Jun. 29, 1993

[54] PAPER FEEDER

[75] Inventors: Seiichi Hirano; Susumu Murayama, both of Suwa, Japan

[73] Assignee: Seiko Epson Corporation, Tokyo, Japan

[21] Appl. No.: 842,371

[22] PCT Filed: Feb. 27, 1991

[86] PCT No.: PCT/JP91/00259

§ 371 Date: Mar. 27, 1992

§ 102(e) Date: Mar. 27, 1992

[87] PCT Pub. No.: WO92/02441

PCT Pub. Date: Feb. 20, 1992

[30] Foreign Application Priority Data

Aug. 8, 1990 [JP] Japan ..... 3-211417

[51] Int. Cl.[5] ..... B65H 3/06

[52] U.S. Cl. ..... 271/10; 271/114; 271/119; 271/227; 271/242; 271/902; 400/636

[58] Field of Search ..... 271/10, 114, 119, 227, 271/242, 902; 400/636

[56] References Cited

U.S. PATENT DOCUMENTS 4,929,105 5/1990 Hirayama ..... 271/902 X
4,990,011 2/1991 Underwood ..... 271/902 X

FOREIGN PATENT DOCUMENTS 57-189951 11/1982 Japan .
58-166454 11/1983 Japan .

*Primary Examiner*—Richard A. Schacher
*Attorney, Agent, or Firm*—Blum Kaplan

[57] ABSTRACT

Disclosed is a paper feeder for sequentially feeding laminated cutform paper to a record/write portion or the like. Proper sagging of the cutform paper is produced on this side of a paper feeding roller during rotations of the paper feeding roller in an anti-feeding direction, thus adjusting the direction thereof. Subsequently, with rotations of the paper feeding roller in a paper feeding direction, a feed roller is temporarily rotated. The paper feeding roller is caused to exactly pull in the cutform paper without exerting abrupt fluctuations in load on the paper feeding roller and the cutform paper.

3 Claims, 6 Drawing Sheets

FIG. 2
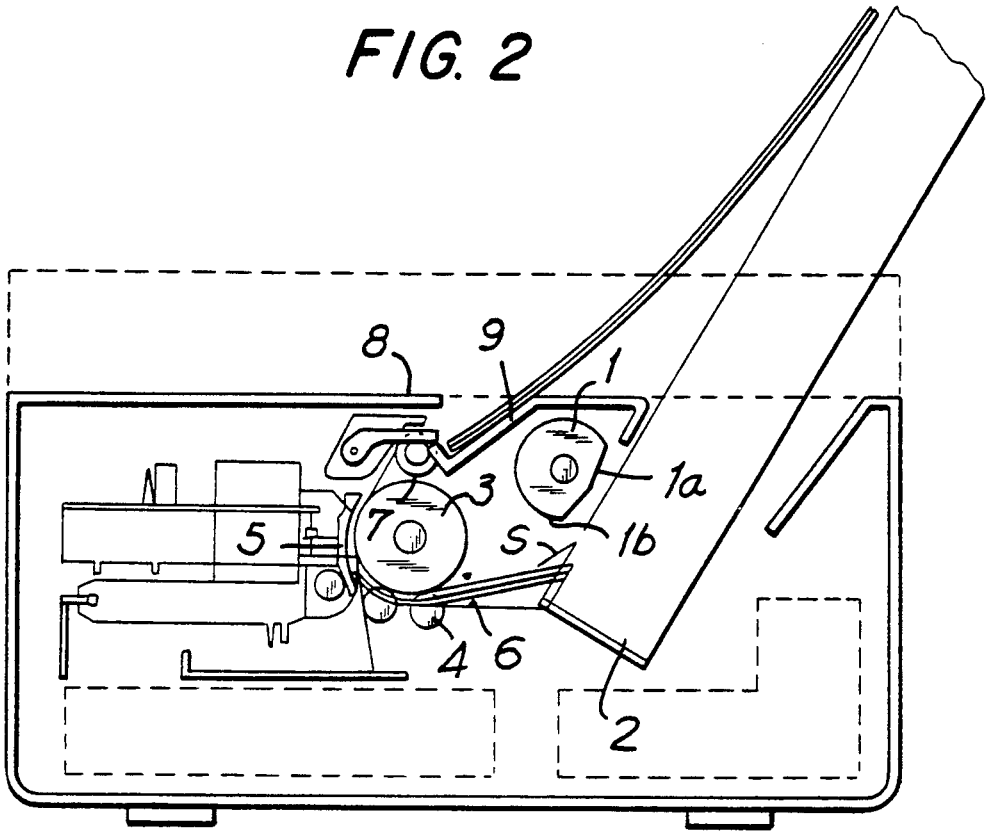
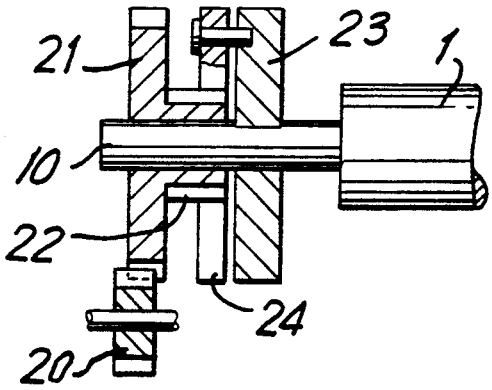
FIG. 3

FIG. 4A
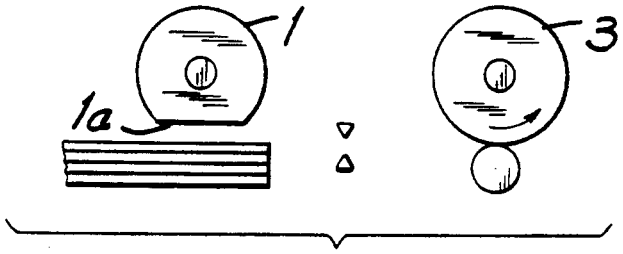
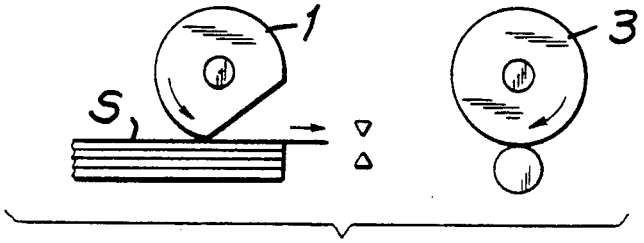
FIG. 4B
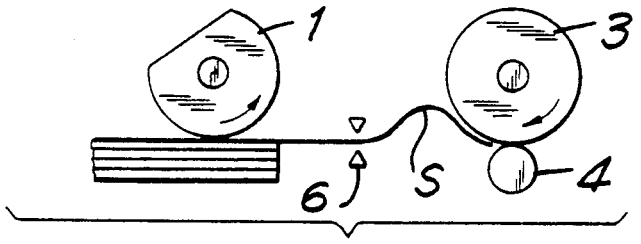
FIG. 4C
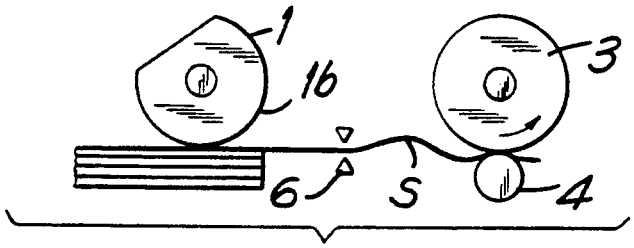
FIG. 4D
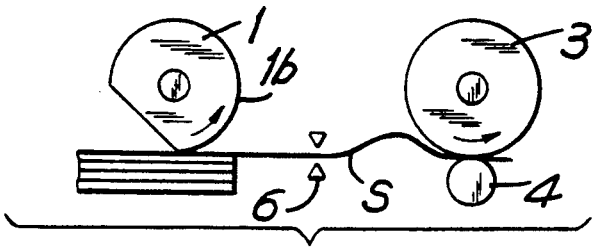
FIG. 4E

PAPER FEEDER

TECHNICAL FIELD

The present invention is directed to a paper feeder for feeding sheets of cutform paper which is applied to a printer or a copying machine.

BACKGROUND ARTS

A paper feeding means for sequentially feeding sheets of cutform paper accommodated in a feed tray to a record/write portion or the like takes the following mechanism. Typically, the laminated cutform paper is pushed against a feed roller from the rear face. The uppermost cutform paper is fed out towards the paper feeding roller by a frictional force with the feed roller. Thereafter, the feed roller is brought into a loose rotating state, and a main paper feeding process is entrusted to the paper feeding roller.

In this type of feeding mechanism, however, if a pressure of contact between the uppermost cutform paper and the feed roller differs in respective parts in an axial direction, the cutform paper can not be fed out in a proper direction. Besides, the paper feeding roller which has taken over this operation pulls in the cutform paper in an as-inclined state. As a result, this causes not only inconveniences wherein an inclined original image is copied on the paper surface, and recording/writing processes are effected obliquely but also a problem of producing a paper jam and skew.

To cope with such problems, Japanese Patent Publication No. 58-6677 proposed an apparatus arranged as follows. At the onset of feeding the paper, the paper feeding roller makes reverse rotations, at which portion the cutform paper is restrained from being pulled in. The cutform paper is adjusted in the proper direction. At a stage of producing some sagging of the cutform paper, the feed roller is stopped. Simultaneously, the paper feeding roller is changed over to forward rotations. The cutform paper is thus properly pulled in the record/write portion.

This type of apparatus, however, presents the following problems. The paper feeding roller changed over to the forward rotations pulls in the cutform paper. During this process, fluctuations in intensive load based on a frictional contact between the feed roller and the cutform paper instantaneously when sagging disappears act on the cutform paper and the feed roller as well. In consequence, a pull-in deviation is caused, or the cutform paper is to be ruptured.

DISCLOSURE OF INVENTION

It is an object of the present invention, which has been devised in the light of such problems, to provide a paper feeder equipped with a novel driving force transmission mechanism which prevents abrupt fluctuations in load from acting on cutform paper and a paper feeding roller after a changeover to forward rotations has been effected.

To accomplish this object, according to one aspect of the invention, there is provided a paper feeder comprising: a feed roller for sequentially feeding sheets of laminated cutform paper; a paper feeding roller disposed forward in a paper feeding direction of the feed roller; a driving means for rotationally driving the paper feeding roller per paper feeding operation initially in anti-feeding direction and subsequently in the feeding direction; and a driving force transmitting means operating while interlocking with the driving means to rotate the feed roller in the feeding direction with a quantity enough to cause sagging of the cutform paper between the paper feeding roller and the feed roller during rotations in the anti-feeding direction of the paper feeding roller and subsequently, with a changeover of the paper feeding roller to rotations in the feeding direction, cause the feed roller to temporarily rotate in the feeding direction once again.

Based on this construction, proper sagging of the cutform paper is produced on this side of the paper feeding roller during initial rotations of the paper feeding roller in an anti-feeding direction, thereby adjusting the direction thereof. Subsequently, with rotations of the paper feeding roller in a paper feeding direction, the feed roller is temporarily rotated. As a result, the paper feeding roller is caused to perform an exact pull-in operation without exerting abrupt fluctuations in load on the paper feeding roller and the cutform paper.

BRIEF DESCRIPTION OF THE DRAWINGS

FIG. 2 is a diagram showing one example of a printer to which the transmission mechanism is applied;

FIG. 3 is a sectional view depicting a shaft end of a feed roller;

FIGS. 4A through 4E are diagrams of assistance in explaining a series of paper feeding operations;

BEST MODE FOR CARRYING OUT THE INVENTION

Figure 1A:
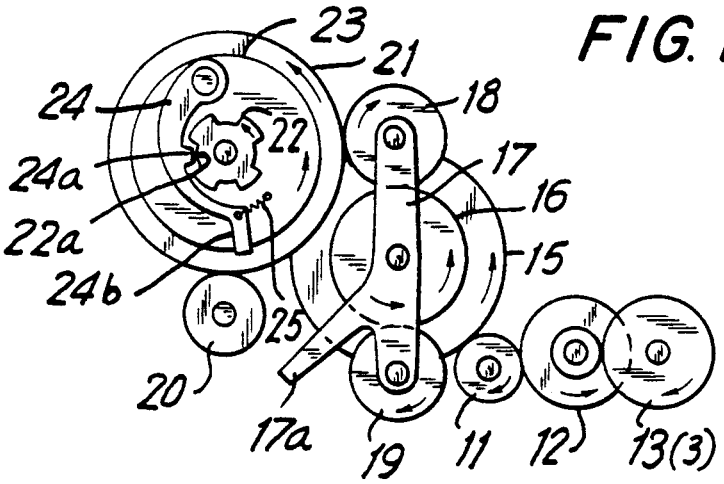
FIGS. 1A through 1C are block diagrams of a driving force transmission mechanism in one embodiment of the present invention, each showing an operating state thereof.

Illustrative embodiments of the present invention will hereinafter be described with reference to the accompanying drawings.

FIGS. 1 through 4 show one embodiment of this invention which employs a D-shaped feed roller.

To start with, an outline of a printer to which the apparatus of this invention is applied will be explained referring to FIG. 2. In the Figures, the numeral 1 represents a feed roller assuming a D-shape in section and partly formed with a notched portion 1*a* which does not contact a sheet of cutform paper s. The feed roller 1 includes an arc member 1*b* an effective paper feed peripheral length of which is set longer than a length corresponding to an appropriate quantity of sagging generated between a platen roller 3 and the roller 1. The roller 1 makes one rotation per feeding operation, thus singly feeding out sheets of cutform paper s laminated in a feed tray 2. During a standby, the roller 1 is constructed to be intermittently driven through a driving force transmission mechanism which will be mentioned later so that the roller 1 stops in a non-contact state to direct the notched member 1*a* towards the cutform paper s. Designated at 3 is a platen roller driven by an unillustrated motor to make forward and reverse rotations. The platen roller 3 is constructed to initially make a reverse rotation for temporarily restraining a passage of the top end of the cutform paper s, thus adjusting a direction of the cutform paper s fed by the feed roller 1. Subsequently, the platen roller is switched to make a forward rotation for feeding out the cutform paper s to a recording head 5.

FIG. 1 illustrates the driving force transmission mechanism, conceived as one embodiment of the invention, for rotating the feed roller 1 at a predetermined timing to interlock with the forward/reverse rotations of the platen roller 3.

Referring to the Figure, the numeral 11 denotes a driving pinion attached to the shaft of an unillustrated driving motor. The pinion 11 is constructed to transmit the driving force to a platen gear 13 fixed via a reduction gear 12 to a shaft end of the platen roller 3 on one hand and meshes with a gear wheel 15 on the other hand. The pinion 11 transmits the rotations in the feeding direction to the feed roller 1 at a periphery speed slightly higher than that of the platen roller 3 through a sun gear 16 rotating integrally therewith and a planet gear mechanism which will be mentioned later.

Figure 1B:
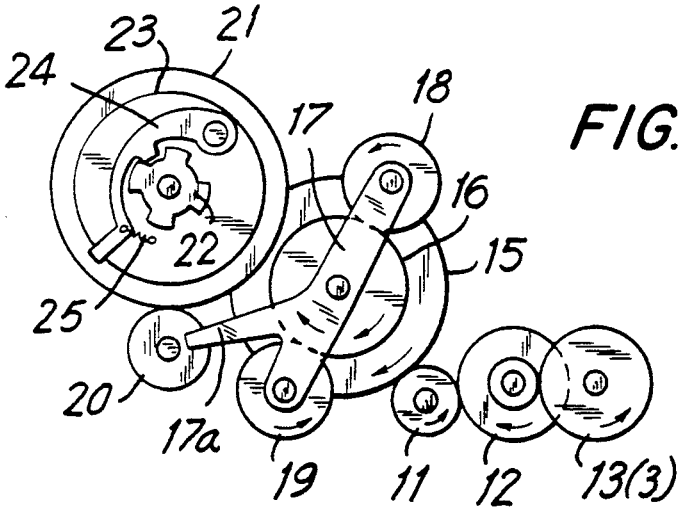
Figure 1C:
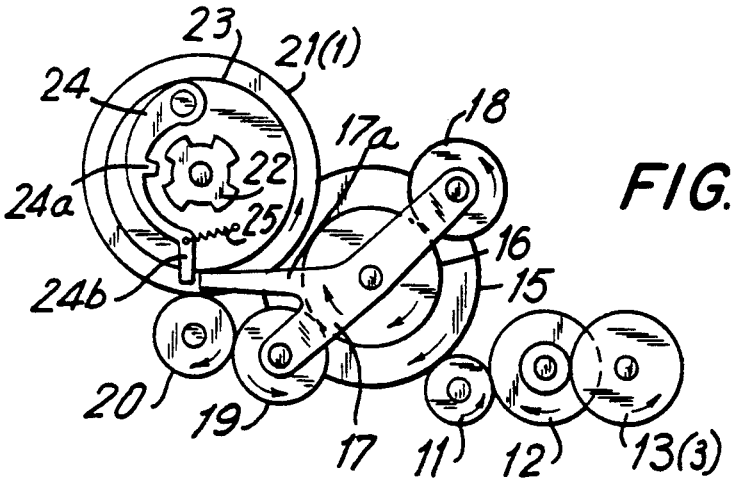

Indicated at 17 is a deformation T-shaped lever swayably pivotally supported on the shaft of the sun gear 16. Fitted to both ends of the lever 17 are first and second planet gears 18, 19 which constantly engage with the sun gear 16. As illustrated in FIG. 1A, when the driving pinion 11 causes the platen roller 3 to rotate in an arrowed direction, i.e., in a direction opposite to the feeding direction, the lever 17 rotates anticlockwise in the Figure through the planet gears 18, 19. The second planet gear 18 meshes directly with a feed roller gear 21, whereby the rotary driving force in the arrowed direction in the Figure is transmitted to this gear 21. As illustrated in FIG. 1C, when the driving pinion 11 makes the platen roller 3 rotate in the feeding direction, the lever 17 rotate clockwise in the Figure through the planet gears 18, 19. The second planet gear 19 meshes with an idler 20, whereby the rotary driving force in the same arrowed direction is transmitted to the feed roller gear 21 through this idler 20. On the other hand, as depicted in FIG. 3, a feed roller gear 21 and a ratchet 22 integral therewith are loosely fitted to a shaft 10 of the feed roller 1. Fixed to this shaft 10 is a clutch plate 23 adjacent to the ratchet 22. An engaging lever 24 including a pawl 24*a* is pivotally supported on the clutch plate 23 in a biased state so that the engaging lever 24 constantly engages with the ratchet 22 with the aid of a spring 25. A top end 24*b* of this engaging lever 24 extends in a rotary region of the deformation T-shaped lever 17. As illustrated in FIG. 1C, the top end 24 impinges on a top end of a pawl stopper arm 1*a* partially branched off, when the deformation T-shaped lever 17 rotates clockwise in the Figure. The engagement with the ratchet 22 is thereby released.

Note that the numeral 6 in FIG. 2 denotes a paper end detecting sensor, disposed on this side of the platen roller 3, for outputting a signal to an unillustrated control circuit to change over the driving motor to the forward rotations when a predetermined amount of sagging of the cutform paper s is reached. Designated at 7 is a delivery roller for ejecting the cutform paper s undergoing a recording process onto a delivery tray 9 in cooperation with a pressure lever 8.

Figure 5:
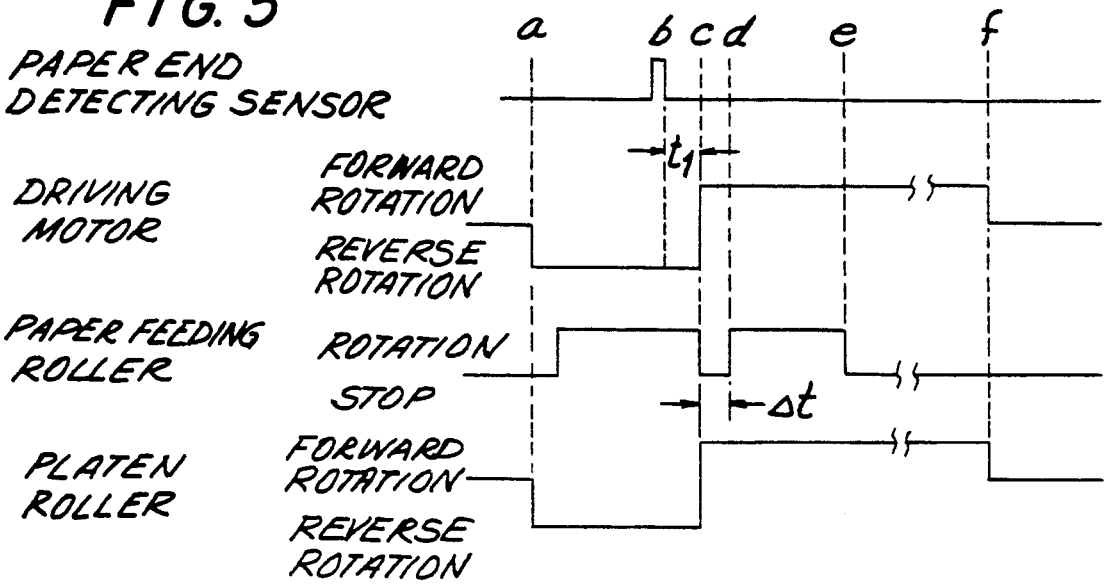
FIG. 5 is a diagram showing operational timings.

Next, the feeding operation by the apparatus discussed above will be explained with reference to FIGS. 1, 4 and 5.

In a standby status, the driving motor is in a stop status after making the forward or reverse rotations. For this reason, the deformation T-shaped lever 17 rotates, as illustrated in FIG. 1C, clockwise together with the sun gear 16 which also rotates clockwise. The lever 17 at its rotary terminal causes the stopper arm 17*a* to protrude into the rotary region of the engaging lever 24, thus holding it. In that position, the lever 17 restrains the rotations of the clutch plate 23, thereby stopping the feed roller 1 in such a posture that the feed roller 1 does not contact the cutform paper s, viz., the notched member 1*a* is directed to the cutform paper s (FIG. 4A).

At a timing a, a feed instruction signal is outputted from an unillustrated sequence control circuit of the printer. At this time, the driving motor is switched to make the reverse rotations from the forward rotations or from the stopping status. As a result, the platen roller 3, as illustrated in FIG. 1A, starts rotating in the arrowed direction in the Figure, i.e., in the anti-feeding direction through the driving pinion 11, the reduction gear 12 and the platen gear 13. On the other hand, the gear wheel 15 meshing with the driving pinion and the sun gear 16 integral therewith start rotating in the direction opposite thereto, i.e., in the anticlockwise direction. The T-shaped lever 17 is rotated anticlockwise in the Figure through the planet gears 18, 19 meshing therewith. The engaging lever 24 is thereby released from being stopped by the pawl stopper arm 17*a*. A pawl 24*a* provided on the lever 24 is engaged with one of engaging recesses 22*a* of the ratchet 22. At the same moment, the first planet gear 18 is meshed directly with the feed roller gear 21 to give the rotations in the feeding direction thereto. Hence, the clutch plate 23 rotates in the same direction as that of the feed roller gear 21, thereby transmitting the rotations to the feed roller 1 stopping in such a way that the notched member 1*a* faces to the cutform paper s. The upper most cutform paper s among sheets of cutform paper s laminated on the feed tray 2 is fed out to the platen roller 3 (FIG. 4B).

With subsequent rotations of the feed roller 1, the cutform paper s passing under the paper end detecting sensor 6 is fed between the platen roller 3 rotating in the anti-feeding direction and a pinch roller 4. The passage thereof is hindered herein, and a predetermined amount of sagging is caused on this side. In this state, a front edge of the cutform paper s uniformly contacts peripheral faces of the two rollers 3, 4 by dint of a flexibility of its own, whereby the cutform paper is adjusted in the proper direction (FIG. 4C).

On the other hand, the sequence control circuit receives a detection signal from the paper end detecting sensor 6 at a timing b. The sequence control circuit then outputs a signal at an interval of time T1 till sagging of the cutform paper s further grows. The sequence control circuit changes over the driving motor from the reverse rotations to the forward rotations at a timing c. In consequence of this, the platen roller 3 is, as depicted in FIG. 1B, immediately changed over to the rotations in the feeding direction. The cutform paper s blocked between the pinch roller and the platen roller 3 is fed out to a printing head 5.

On the other hand, the sun gear 16 is changed over to the clockwise rotations, reversal to the previous rotations, in the Figure through the gear wheel 15. The sun gear 16 makes the deformation T-shaped lever 17 rotate clockwise in the Figure through the planet gears 18, 19 meshing therewith. The first planet gear 18 is separated from the feed roller gear 21 (FIG. 1B).

The driving force of the feed roller 1 is cut off, and hence the roller 1 enters a loose rotating state for a slight time Δt. In the meantime, the platen roller 3 feeds out the cutform paper s, while sagging formed on this side disappears (FIG. 4D).

In this manner, after the slight time Δt has elapsed, the deformation T-shaped lever 17 which continues to rotate clockwise comes to the rotary terminal at a timing d. At this time, the second planet gear 19 is caused to mesh with the idler 20. For this reason, the feed roller gear 21 starts rotating via the idler 20. The rotations are transmitted via the ratchet 22, the engaging lever 24 and the clutch plate 23 to the feed roller 1. The cutform paper s is fed out at a peripheral speed higher than that of the platen roller 3. As a result, sagging is again produced between the platen roller and the feed roller 1. Hence, the platen 3 feeds out the cutform paper s to the printing head 5 without continuously undergoing the load (FIG. 4E).

In this way, the feed roller 1 makes one rotation, and the notched member 1*a* again comes to such a position as to confront with the cutform paper s at a timing d. At this time, as illustrated in FIG. 1C, the engaging lever 24 impinges on the top end of the pawl stopper arm 17. The lever 24 turns rightward to release the engagement with the ratchet 22. At this portion, the clutch plate 23 integral with the feed roller 1 is stopped. Therefore, the feed roller 1 reverts to the standby posture depicted in FIG. 4A from the position shown in FIG. 4E.

In this state, a first set of cutform paper S is all fed in by the platen roller 3 which goes on rotating. The driving motor is stopped in response to a signal outputted from the sequence control circuit at a timing f. Concomitantly, the platen roller 3 is also stopped, and it follows that one cycle of feeding the paper is finished.

Figure 6A:
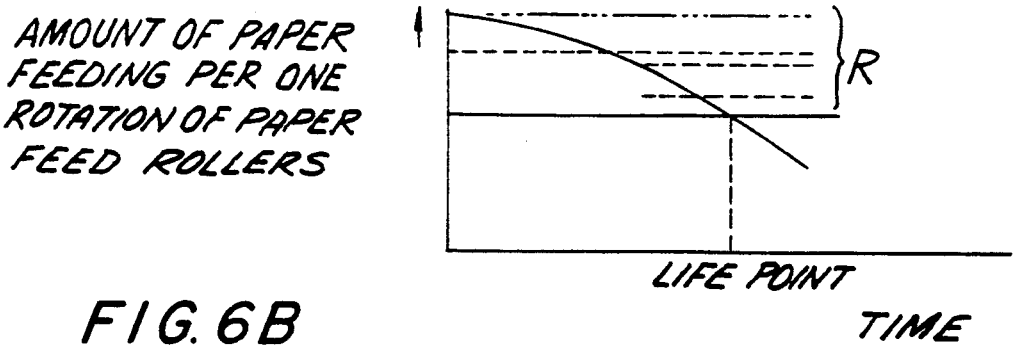
FIGS. 6A and 6B are charts each showing a lifespan of the feed roller in a comparison between the apparatus of the invention and the conventional apparatus.
Figure 6B:
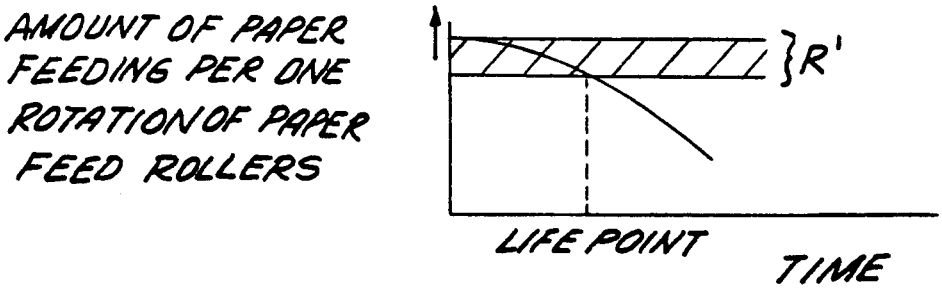

Incidentally, the D-shaped feed roller 1 employed in this embodiment includes the arc member the peripheral length of which is set longer than a length corresponding to an appropriate amount of sagging (R) formed between the platen roller and the roller 1 (FIG. 6A). Since the peripheral length of the arc member of the D-shaped feed roller 1 is larger than required to obtain an appropriate amount of the sagging R, the appropriate amount of sagging R is increased as shown in FIG. 6A. With this arrangement, the paper can be fed again after the platen roller 3 has been changed over to the rotations in the feeding direction. That provides an allowance as compared with a case where the peripheral length is simply set to the length corresponding to the appropriate amount of sagging (FIG. 6B). FIG. 6B illustrates a second embodiment wherein the arc length of the D-shaped roller is smaller than that of FIG. 6A and accordingly the appropriate amount of sagging R′ is smaller. Thus, if the frictional force of the peripheral face decreases, the useful life (lifepoint) is decreased as shown in the comparison of FIG. 6A and FIG. 6B. Even when a frictional force on the peripheral face drops down due to a long-term use, it is possible to maintain a feeding function to generate the appropriate amount of sagging at the onset of feeding the paper.

Figure 7:
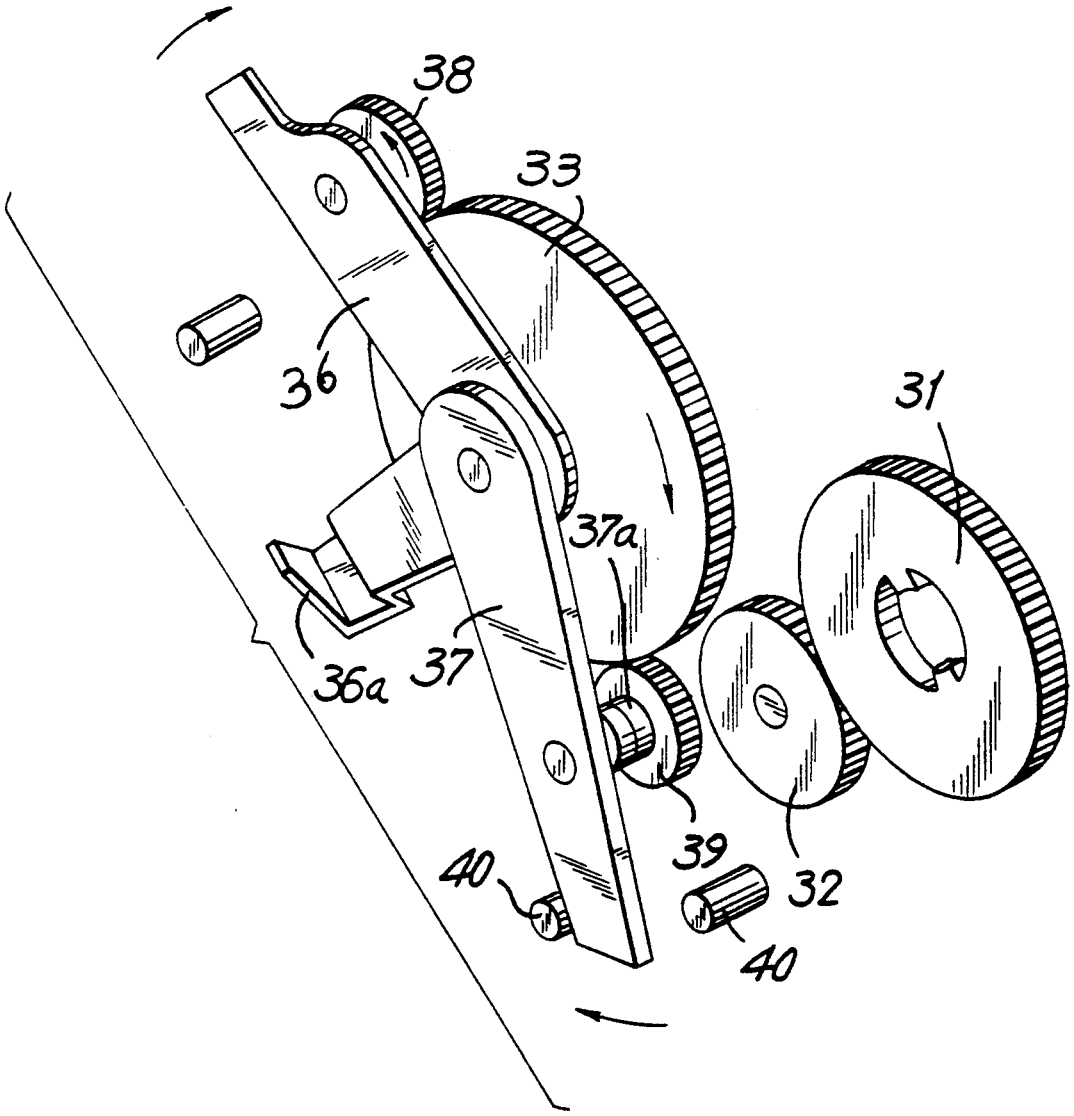
FIG. 7 is a perspective view depicting a driving force transmission mechanism in another embodiment of this invention.

FIGS. 7 and 8 in combination show a second embodiment of this invention in association with a driving force transmission mechanism of the paper feeder which uses an ordinary round type feed roller.

Referring to the Figures, the numeral 33 represents a platen gear driven by an unillustrated driving motor to make forward and reverse rotations. Engaged with this platen gear 33 are two pieces of planet gears 38, 39 which are axially supported on the ends of first and second levers 36, 37 each rotating with the platen shaft serving as a fulcrum. The rotations are transmitted to a feed roller gear 31 by any one of the planet gears 38, 39 in accordance with the rotating direction of the platen gear 33. The platen gear 33 is constructed to rotate an unillustrated feed roller fixed onto the shaft thereof in the feeding direction at a peripheral speed slightly lower than that of the platen.

Figure 8A:
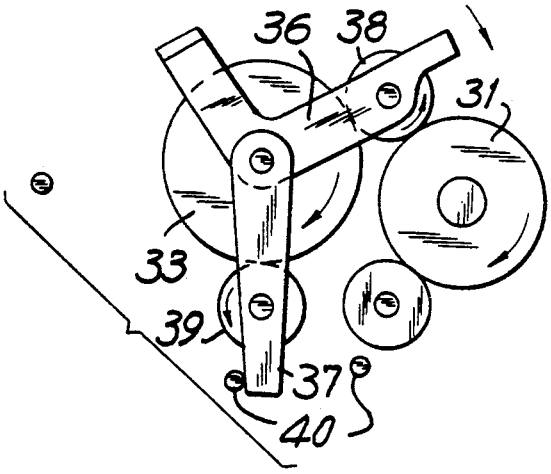
FIGS. 8A to 8D are diagrams of assistance in explaining the respective operating states of the transmission mechanism described above.
Figure 8B:
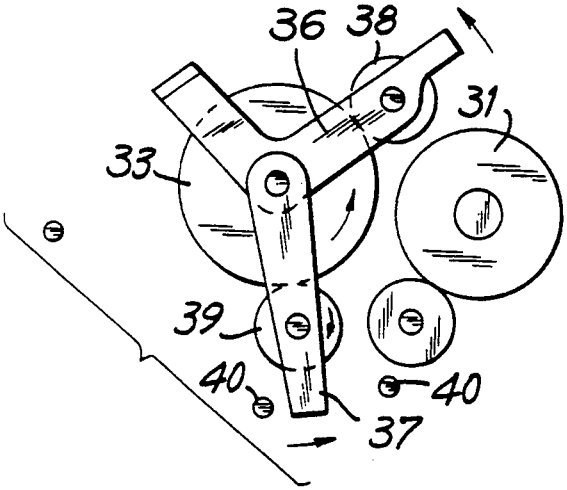
Figure 8C:
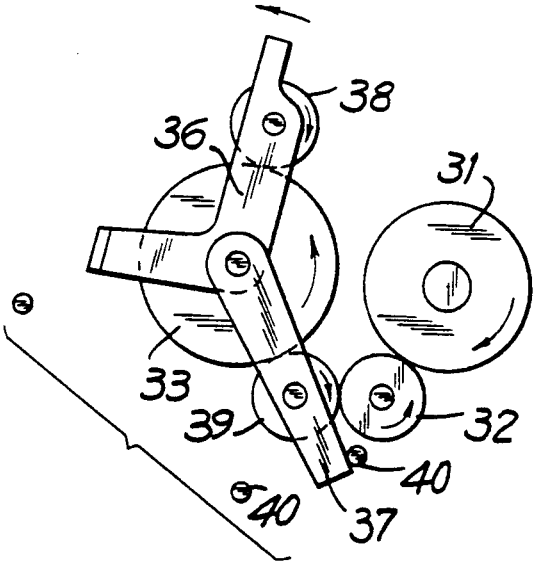
Figure 8D:
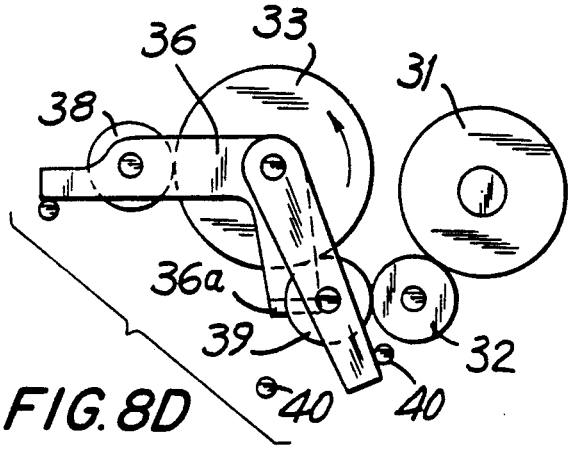

The first lever 36 incorporated into this mechanism is of a crank type and has its one end on which the first planet gear 38 is axially supported. The other end of the lever 36 is formed with an inclined surface 36*a* for raising the gear. As illustrated in FIG. 8D, the gear raising inclined surface 36*a* acts to thrust up the second planet gear 39 in the axial direction at the rotary terminal of the lever 36 in the anticlockwise direction. This gear 39 is thereby separated from a platen gear 33 and an idler 32 and well. The lever 36 rotates clockwise during reverse rotations of the platen gear 33, i.e., during clockwise rotations in the Figure. The lever 36 is configured to cause the planet gear 38 axially supported on the top end thereof to mesh with the feed roller gear 31, whereby the gear 31 is rotated in the feeding direction.

On the other hand, the second lever 37 has its one end vertically provided with a shaft on which the second gear 39 is supported rotatably slidably and axially. In the normal state, the gear 39 is biased by a coil spring 37*a* interposed between the lever 37 and the gear itself, with the result that the gear 39 is thrust out in such a position as to mesh with the platen gear 33 and the idler 32 as well. A rotary range of this lever 37 is restricted by bilaterally provided stoppers 40, 40. As illustrated in FIG. 8C, during the forward rotations of the platen gear 33, viz., rotations in the anticlockwise direction in the Figure, the lever 37 rotates anticlockwise. The lever is constructed to transmit the rotations in the feeding direction to the feed roller by engaging the retained second planet gear 39 with the idler 32 meshing with the feed roller gear 31.

In this embodiment, the platen gear 33 driven by the unillustrated driving motor in response to a feed instruction signal, as depicted in FIG. 7, rotates in the arrowed direction, i.e., the anti-feeding direction in the Figure. Then, the second lever 37 rotates clockwise in the Figure to release the engagement between the second planet gear 39 and the idler 32. The first lever 36 rotates clockwise in the Figure. The first planet gear 38 axially supported on the lever 36 meshes with the feed roller gear 31, thereby rotating an unillustrated feed roller in the feeding direction (FIG. 8A). For this reason, as in the same way with the first embodiment, the cutform paper fed out by the feed roller is hindered by the platen roller making the reverse rotations. As a result, sagging is produced on this side thereof (FIG. 4C). If sagging exceeds a constant quantity, the sequence control circuit switches the driving motor to the forward rotations in accordance with a detection signal given from a paper detecting sensor. The first lever 36 is thereby rotated anticlockwise in the Figure to cut off the transmission of the driving force to the feed roller by use of the first planet gear 38 (FIG. 8B). The second lever 37 rotating anticlockwise causes the retained second planet gear 39 to mesh with the idler 32 at an interval of slight time Δt required for the rotation. The rotary driving force in the same direction is again transmitted to the feed roller (FIG. 8C), the timing (d) in FIG. 5)). Hence, the feed roller, as in the same way shown in the FIG. 4D, restrains an excessive load on the platen roller by resuming the paper feed in such a course that the platen roller pulls in the sagged cutform paper. The feed roller also prevents an intensive tensile force from acting on the cutform paper during that period.

After a further slight time has elapsed, and when the first lever 36 reaches the rotary terminal in the anti-clockwise direction, the gear raising inclined surface 36*a* provided at the other end of the first lever 36 intrudes into the underside of the second planet gear 39. This gear 39 is thereby thrust up toward the second lever 37, resisting the coil spring 37*a*.

The second planet gear 39 is released from the engagement with the platen gear 33 and the idler 32, thereby cutting off the transmission of the driving force to the feed roller gear 31.

Incidentally in this embodiment, as discussed above, the peripheral speed of the platen roller is set slightly higher than that of the feed roller. Hence, the platen roller absorbs sagging of the paper till the driving force of the feed roller is cut off and gradually increases the tensile force on the cutform paper. Even if the driving force of the feed roller is thereafter cut off, the cutform paper is continuously fed in towards the head without undergoing abrupt fluctuations in load.

As discussed above, according to the present invention, the feed roller is allowed to rotate with a quantity enough to cause sagging of the cutform paper during the rotations in the anti-feeding direction of the paper feeding roller. Subsequently, with a changeover of the paper feeding roller to the rotations in the feeding direction, the feed roller is allowed to temporarily rotate in the feeding direction once gain. During the rotations of the paper feeding roller in the anti-feeding direction, sagging of the cutform paper is produced on this side thereof. The direction thereof is thereby properly adjusted. At the same moment, the feed roller is again rotated in the feeding direction when changing over the paper feeding roller to the rotations in the feeding direction. The abrupt fluctuations in load on the paper feeding roller are thereby eliminated. Simultaneously, the tensile force acting on the cutform paper is reduced to prevent damages to the cutform paper. This leads to well-formed images.

Industrial Applicability

The present invention has been described so far by exemplifying the printer in which the platen roller is disposed in front of the feed roller. A pair of paper feeding rollers may be disposed in this portion in place of the platen roller to permit the same rotary operation as the above. When being applied to an electronic photo device, a pair of resist rollers as a substitute for these rollers may be disposed.

What is claimed is:

1. A paper feeder comprising:

a feed roller for sequentially feeding sheets of laminated cutform paper;

a paper feeding roller disposed forward in a paper feeding direction of said feed roller;

a driving means for rotationally driving said paper feeding roller per paper feeding operation initially in an anti-feeding direction and subsequently in said feeding direction; and a driving force transmitting means operating while interlocking with said driving means to rotate said feed roller in said feeding direction with a quantity enough to cause sagging of said cutform paper between said paper feeding roller and said feed roller during rotations in said anti-feeding direction of said paper feeding roller and subsequently, with a changeover of said paper feeding roller to rotations in said feeding direction, cause said feed roller to temporarily rotate in said feeding direction once again.

2. The paper feeder as set forth in claim 1, said feed roller is formed as a roller assuming a D-shape in section, and a peripheral length of an arc member of said roller is set larger than a length corresponding to an amount of sagging caused between said paper feeding roller and said feed roller.

3. The paper feeder as set forth in claim 1, wherein a peripheral speed of said paper feeding roller is set higher than that of said feed roller.

* * * * *